US008970334B2

(12) United States Patent
Choi

(10) Patent No.: US 8,970,334 B2
(45) Date of Patent: Mar. 3, 2015

(54) MAGNETIC SUBSTANCE HOLDING DEVICE USING PERMANENT MAGNET ENERGY CONTROL

(71) Applicant: TaeKwang Choi, Gyeonggi-do (KR)

(72) Inventor: TaeKwang Choi, Gyeonggi-do (KR)

( * ) Notice: Subject to any disclaimer, the term of this patent is extended or adjusted under 35 U.S.C. 154(b) by 0 days.

(21) Appl. No.: 14/144,123

(22) Filed: Dec. 30, 2013

(65) Prior Publication Data

US 2014/0361860 A1 Dec. 11, 2014

(30) Foreign Application Priority Data

Jun. 7, 2013 (KR) ..... 10-2013-0065478

(51) Int. Cl.
*H01F 7/20* (2006.01)
*H01F 7/04* (2006.01)

(52) U.S. Cl.
CPC ..... *H01F 7/04* (2013.01)
USPC ..... 335/285; 335/302

(58) Field of Classification Search
USPC ..... 335/285
See application file for complete search history.

(56) References Cited

U.S. PATENT DOCUMENTS

| | | | | |
|---|---|---|---|---|
| 4,075,589 | A * | 2/1978 | Braillon | 335/286 |
| 4,090,162 | A * | 5/1978 | Cardone et al. | 335/289 |
| 4,542,361 | A * | 9/1985 | Cavanagh | 335/230 |
| 4,847,582 | A * | 7/1989 | Cardone et al. | 335/289 |
| 5,243,314 | A * | 9/1993 | Maruyama | 335/285 |

(Continued)

FOREIGN PATENT DOCUMENTS

| | | |
|---|---|---|
| JP | 2000058318 | 2/2000 |
| JP | 03165203 | 1/2011 |

(Continued)

OTHER PUBLICATIONS

Notice of Allowance dated Oct. 8, 2013 regarding Korean Patent Application No. 2013-0065478, and English Translation.

*Primary Examiner* — Shawki S Ismail
*Assistant Examiner* — Lisa Homza
(74) *Attorney, Agent, or Firm* — Arent Fox LLP

(57) ABSTRACT

There is provided a magnetic substance holding device that controls permanent magnet energy with which it is possible to obtain a strong holding force with a simple structure.

The magnetic substance holding device that controls permanent magnet energy of the present invention includes an N pole piece formed of a magnetic substance, wherein the N pole piece has a holding face to which a target formed of a magnetic substance is attached and a base attachment face at a side different from the holding face; an S pole piece formed of a magnetic substance, wherein the S pole piece has a holding face to which the target is attached and a base attachment face at a side different from the holding face; a permanent magnet that is disposed such that the N pole thereof comes in contact with the N pole piece and the S-pole thereof comes in contact with the S pole piece; a coil that is wound around at least one of the N pole piece and the S pole piece; a base that is movable between a first position at which the base does not come in contact with both of the base attachment face of the N pole piece and the base attachment face of the S pole piece and a second position at which the base comes in contact with both of the base attachment face of the N pole piece and the base attachment face of the S pole piece; and a control device that controls a current applied to the coil, in which the target is held or released by applying a current to the coil through the control device such that at least one of the N pole piece and the S pole piece is magnetized.

10 Claims, 9 Drawing Sheets

(56) References Cited

U.S. PATENT DOCUMENTS

| | | | | |
|---|---|---|---|---|
| 5,334,965 | A * | 8/1994 | Dolgin | 335/216 |
| 6,002,317 | A * | 12/1999 | Pignataro | 335/289 |
| 6,229,422 | B1 * | 5/2001 | Pignataro | 335/289 |
| 6,288,623 | B1 * | 9/2001 | Janzen | 335/291 |
| 6,489,871 | B1 * | 12/2002 | Barton | 335/285 |
| 7,015,780 | B2 * | 3/2006 | Bernstein et al. | 335/302 |
| 7,750,774 | B2 * | 7/2010 | Fullerton et al. | 335/285 |
| 7,760,058 | B2 * | 7/2010 | Fullerton et al. | 335/285 |
| 7,812,697 | B2 * | 10/2010 | Fullerton et al. | 335/306 |
| 7,839,244 | B2 * | 11/2010 | Fullerton et al. | 335/284 |
| 7,839,246 | B2 * | 11/2010 | Fullerton et al. | 335/306 |
| 7,839,247 | B2 * | 11/2010 | Fullerton et al. | 335/306 |
| 7,839,248 | B2 * | 11/2010 | Fullerton et al. | 335/306 |
| 7,843,295 | B2 * | 11/2010 | Fullerton et al. | 335/306 |
| 7,843,297 | B2 * | 11/2010 | Fullerton et al. | 335/306 |
| 7,855,624 | B2 * | 12/2010 | Fullerton et al. | 335/306 |
| 7,961,069 | B2 * | 6/2011 | Fullerton et al. | 335/306 |
| 8,031,038 | B2 * | 10/2011 | Kimura | 335/285 |
| 8,098,122 | B2 * | 1/2012 | Fullerton et al. | 335/285 |
| 8,314,671 | B2 * | 11/2012 | Fullerton et al. | 335/285 |
| 8,314,672 | B2 * | 11/2012 | Fullerton et al. | 335/285 |
| 8,832,940 | B2 * | 9/2014 | Sarh et al. | 29/897.2 |
| 2007/0290780 | A1 * | 12/2007 | Tiberghien et al. | 335/285 |

FOREIGN PATENT DOCUMENTS

| | | | |
|---|---|---|---|
| KR | 101125280 | B1 | 3/2012 |
| KR | 101130218 | | 3/2012 |
| WO | WO2012039548 | A1 | 3/2012 |

* cited by examiner

MAGNETIC SUBSTANCE HOLDING DEVICE USING PERMANENT MAGNET ENERGY CONTROL

CROSS-REFERENCE TO RELATED APPLICATIONS

This application claims the priority of Korean Patent Application No. 2013-0065478 filed on Jun. 7, 2013, in the Korean Intellectual Property Office, the disclosure of which is incorporated herein by reference.

BACKGROUND OF THE INVENTION

1. Field of the Invention

The present invention relates to a magnetic substance holding device, and more particularly, to a magnetic substance holding device that controls permanent magnet energy with which it is possible to obtain a strong holding force with a simple structure and to change from holding to releasing and vice versa by using only a low current.

2. Description of the Related Art

A magnetic substance holding device such as a permanent magnet workholding device is used to attach a target made of a magnetic material such as iron by using a magnetic force, and is widely used in various areas as an internal device attached to a die clamp of an injection molding machine, a die clamp of a press, a chuck of a machine tool, or the like, nowadays.

Basically, the magnetic substance holding device attaches the target formed of a magnetic substance to a holding face by using a strong magnetic force of a permanent magnet. When releasing the target, the magnetic substance holding device separates the target from the holding face by controlling a magnetic flow from the permanent magnet so as not to form the magnetic flow to the holding face.

As a method of controlling the magnetic flow from the permanent magnet, a method of controlling the magnetic flow by rotating another permanent magnet that is rotatably disposed and a method of controlling the magnetic flow by using a separate electromagnet may be used.

The applicant(s) has proposed a magnetic substance holding device using a separate electromagnet (see Patent Literature 1).

Patent Literature 1

International Patent Publication No. WO2012/039548A1

SUMMARY OF THE INVENTION

An object of the present invention is to provide a magnetic substance holding device capable of obtaining a strong holding force with a simple structure by disposing a coil on a pole piece without using a separate electromagnet and controlling the magnetic force of a permanent magnet by using even a low current only when changing from holding to releasing and vice versa.

Another object of the present invention is to provide a magnetic substance holding device capable of exhibiting a strong magnetic force in an optimum area by implementing a structure that can minimize remaining magnetism when releasing a target.

The objects of the present invention are not limited to the aforementioned objects, and other objects, which are not mentioned above, will be apparent to those skilled in the art from the following description.

In order to obtain the object, a magnetic substance holding device that controls permanent magnet energy includes an N pole piece formed of a magnetic substance, wherein the N pole piece has a holding face to which a target formed of a magnetic substance is attached and a base attachment face at a side different from the holding face; an S pole piece formed of a magnetic substance, wherein the S pole piece has a holding face to which the target is attached and a base attachment face at a side different from the holding face; a permanent magnet that is disposed such that the N pole thereof comes in contact with the N pole piece and the S-pole thereof comes in contact with the S pole piece; a coil that is wound around at least one of the N pole piece and the S pole piece; a base that is movable between a first position at which the base does not come in contact with both of the base attachment face of the N pole piece and the base attachment face of the S pole piece and a second position at which the base comes in contact with both of the base attachment face of the N pole piece and the base attachment face of the S pole piece; and a control device that controls a current applied to the coil, in which the target is held or released by applying a current to the coil through the control device such that at least one of the N pole piece and the S pole piece is magnetized.

According to another characteristic of the present invention, the base is movable between a first position at which the base does not come in contact with both of the base attachment face of the N pole piece and the base attachment face of the S pole piece and a second position at which the base comes in contact with both of the base attachment face of the N pole piece and the base attachment face of the S pole piece, the device further includes an elastic member that provides an elastic force in a direction in which the base is away from the N pole piece and the S pole piece; when the base is disposed at the first position, the target is attached to the holding faces of the N pole piece and the S pole piece; and the target is released from the holding faces of the N pole piece and the S pole piece by applying a current to the coil to generate a magnetic flow through the base attachment face of the N pole piece and the base attachment face of the S pole piece and by moving the base to the second position by a magnetic force.

According to still another characteristic of the present invention, the coil is wound around only the N pole piece and is positioned closer to the base than the permanent magnet.

According to still another characteristic of the present invention, the coil is wound around only the N pole piece and is positioned further from the base than the permanent magnet, and the sum of an area of the base attachment face of the N pole piece and an area of the base attachment face of the S pole piece is larger than that the sum of an area of the holding face of the N pole piece and an area of the holding face of the S pole piece.

According to still another characteristic of the present invention, the device further includes a yoke that has an empty space therein and an opening, in which the base is disposed within the empty space and the holding faces of the N pole piece and the S pole piece are exposed to the outside through the opening, and a first reinforced permanent magnet is disposed between the yoke and the N pole piece such that the N pole thereof comes in contact with the N pole piece and the S-pole thereof comes in contact with the yoke, or a second reinforced permanent magnet is disposed between the yoke and the S pole piece such that the S-pole thereof comes in contact with the S pole piece and the N pole thereof comes in contact with the yoke.

According to still another characteristic of the present invention, the S pole piece is a first S pole piece and the permanent magnet is a first permanent magnet, the device further includes: a second S pole piece formed of a magnetic substance, that has a holding face to which the target is attached and a base attachment face at a side different from the holding face; and a second permanent magnet that is disposed such that the N pole thereof comes in contact with the N pole piece and the S-pole thereof comes in contact with the second S pole piece, in which the coil is wound around the N pole piece, and the base extends to face the base attachment face of the second S pole piece.

According to still another characteristic of the present invention, the N pole piece is a first N pole piece and the permanent magnet is a first permanent magnet, the device further includes: a second N pole piece formed of a magnetic substance, that has a holding face to which the target formed of a magnetic substance is attached and a base attachment face at a side different from the holding face; and a second permanent magnet that is disposed such that the S-pole thereof comes in contact with the S pole piece and the N pole thereof comes in contact with the second N pole piece, in which the coil is wound around the S pole piece, and the base extends to face the base attachment face of the second N pole piece.

According to still another characteristic of the present invention, the N pole piece is a first N pole piece, the S pole piece is a first S pole piece, the permanent magnet is a first permanent magnet, the base is a first base, and the elastic member is a first elastic member, the device further includes: a second N pole piece formed of a magnetic substance, that has a holding face to which a target formed of a magnetic substance is attached and a base attachment face at a side different from the holding face; a second S pole piece formed of a magnetic substance, that has a holding face to which the target formed of a magnetic substance is attached and a base attachment face at a side different from the holding face; a second permanent magnet that is disposed such that the N pole thereof comes in contact with the second N pole piece and the S-pole thereof comes in contact with the second S pole piece; a second base formed of a magnetic substance, that is movable between a first position at which the second base does not come in contact with both of the base attachment face of the second N pole piece and the base attachment face of the second S pole piece and a second position at which the base comes in contact with both of the base attachment face of the second N pole piece and the second base attachment face of the second S pole piece; and a second elastic member that provides an elastic force pushing the second base in a direction in which the second base is away from the second N pole piece and the second S pole piece, in which the first N pole piece and the second N pole piece face each other but are spaced from each other, and the coil is disposed to surround both of the first N pole piece and the second N pole piece.

According to still another characteristic of the present invention, the N pole piece is a first N pole piece, the S pole piece is a first S pole piece, the permanent magnet is a first permanent magnet, the base is a first base, and the elastic member is a first elastic member, the device further includes: a second N pole piece formed of a magnetic substance, that has a holding face to which a target formed of a magnetic substance is attached and a base attachment face at a side different from the holding face; a second S pole piece formed of a magnetic substance, that has a holding face to which the target formed of a magnetic substance is attached and a base attachment face at a side different from the holding face; a second permanent magnet that is disposed such that the N pole thereof comes in contact with the second N pole piece and the S-pole thereof comes in contact with the second S pole piece; a second base formed of a magnetic substance, that is movable between a first position at which the second base does not come in contact with both of the base attachment face of the second N pole piece and the base attachment face of the second S pole piece and a second position at which the second base comes in contact with both of the base attachment face of the second N pole piece and the base attachment face of the second S pole piece: and a second elastic member that provides an elastic force in a direction in which the second base is away from the second N pole piece and the second S pole piece, in which the first S pole piece and the second S pole piece face each other but are spaced from each other, and the coil is disposed to surround both of the first S pole piece and the second S pole piece.

According to still another characteristic of the present invention, the target and one or more of the holding face of the N pole piece and the holding face of the S pole piece are fitted to each other, and the one or more of the holding face of the N pole piece and the holding face of the S pole piece is held at a predetermined position of the target when holding.

According to a magnetic substance holding device of the present invention, it is possible to obtain a strong holding force with a simple structure by disposing a coil on a pole piece without using a separate electromagnet, and to control the magnetic force of a permanent magnet by using even a low current only when changing from holding to releasing and vice versa.

Further, it is possible to minimize remaining magnetism when releasing the target.

Further, it is possible to achieve a stronger holding force even using a small space by using a plurality of magnetic substance holding devices that is separately provided.

Further, the device can be used for die clamps, locking devices, connection devices for passenger cars of a train, and roll lifting by changing the shape of the holding faces.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
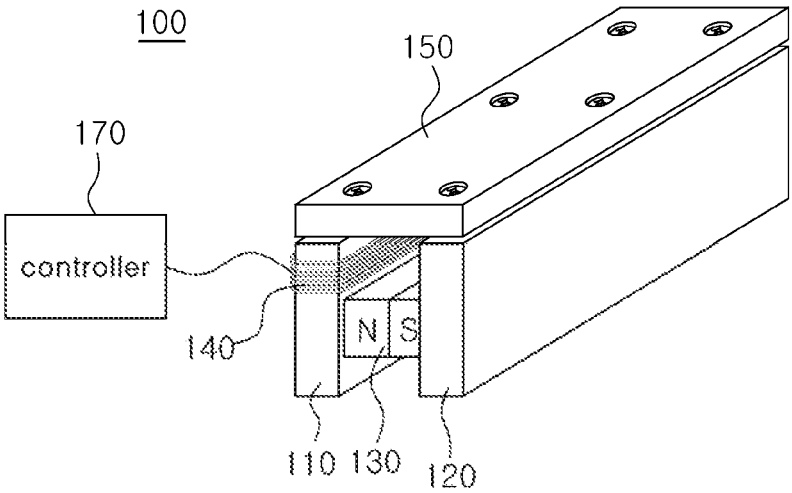
FIG. 1 is a perspective view schematically showing a magnetic substance holding device according to an exemplary embodiment of the present invention.

Various advantages and features of the present invention and methods accomplishing thereof will become apparent from the following description of embodiments with reference to the accompanying drawings. However, the present invention is not limited to exemplary embodiment disclosed herein but will be implemented in various forms. The exemplary embodiments are provided by way of example only so that a person of ordinary skilled in the art can fully understand the disclosures of the present invention and the scope of the present invention. Therefore, the present invention will be defined only by the scope of the appended claims.

Indicating that elements or layers are "on" other elements or layers include both a case in which the corresponding elements are just above other elements and a case in which the corresponding elements are intervened with other layers or elements. Although first, second, and the like are used in order to describe various components, the components are not limited by the terms. The above terms are used only to discriminate one component from the other component. Therefore, a first component mentioned below may be a second component within the technical spirit of the present invention.

The same reference numerals indicate the same elements throughout the specification.

In the drawings, size and thickness of each element are arbitrarily illustrated for convenience of description, and the present invention is not necessarily limited to those illustrated in the drawings.

Respective features of various exemplary embodiments of the present invention can be partially or totally joined or combined with each other and as sufficiently appreciated by those skilled in the art, various interworking or driving can be technologically achieved and the respective exemplary embodiments may be executed independently from each other or together executed through an association relationship.

Hereinafter, magnetic substance holding devices according to exemplary embodiments of the present invention will be described with reference to the accompanying drawings.

Figure 2A:
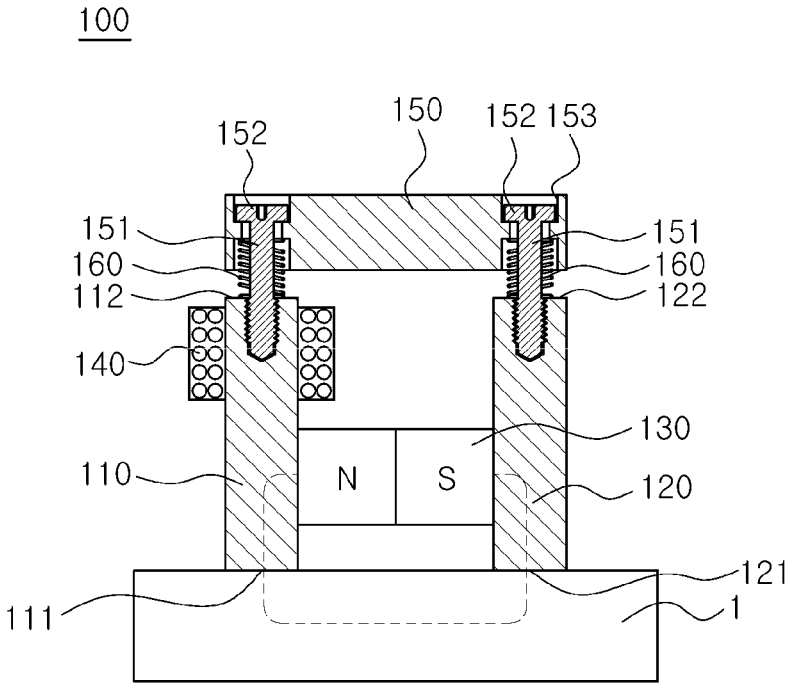
FIG. 2A is a schematic cross-sectional view when the magnetic substance holding device shown in FIG. 1 holds a target.
Figure 2B:
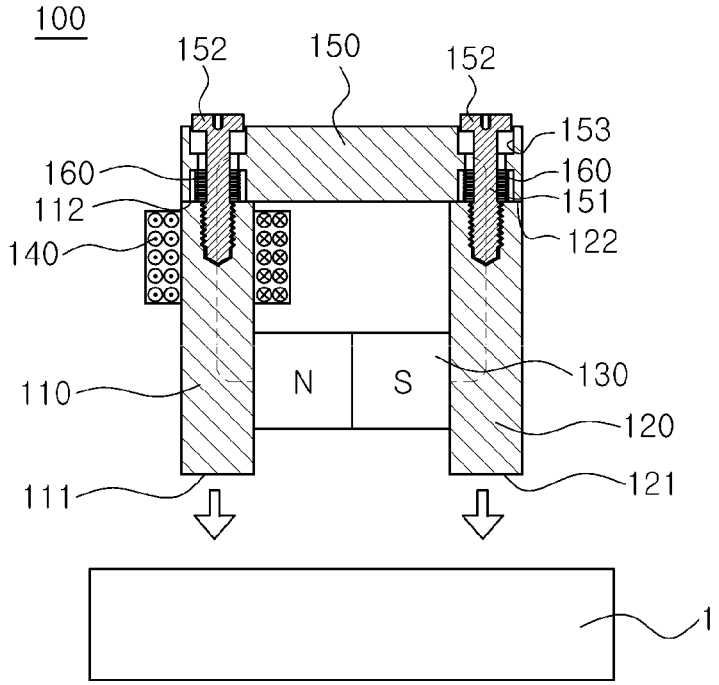
FIG. 2B is a schematic cross-sectional view when the magnetic substance holding device shown in FIG. 1 releases the target.

FIG. 1 is a perspective view schematically showing a magnetic substance holding device according to an exemplary embodiment of the present invention, FIG. 2A is a schematic cross-sectional view when the magnetic substance holding device shown in FIG. 1 holds a target, and FIG. 2B is a schematic cross-sectional view when the magnetic substance holding device shown in FIG. 1 releases the target.

The configuration of a magnetic substance holding device 100 according to an exemplary embodiment of the present invention is described with reference to FIGS. 1, 2A, and 2B.

Referring to FIGS. 1, 2A, and 2B, the magnetic substance holding device 100 according to an exemplary embodiment of the present invention includes an N pole piece 110, an S pole piece 120, a permanent magnet 130, a coil 140, a base 150, springs 160, and a control device 170.

The N pole piece 110 has a holding face 111 to which a target 1 as a magnetic substance is attached and a base attachment face 112 at a different side from the holding face 111. The N pole pieced is a magnetic substance.

The S pole piece 120 has a holding face 121 to which the target 1 as a magnetic substance is attached and a base attachment face 122 at a different side from the holding face 121. The S pole piece is a magnetic substance.

The permanent magnet 130 is disposed such that the N pole comes in contact with the N pole piece 110 and the S pole comes in contact with the S pole piece 120. The number or the shape of the permanent magnet 130 may be freely determined, as long as the permanent magnet is disposed between the N pole piece 110 and the S pole piece 120.

The coil 140 is disposed so as to be wound around at least one of the N pole piece 110 and the S pole piece 120. In the exemplary embodiment, the coil 140 is wound around only the N pole piece 110 and is positioned closer to the base 150 than the permanent magnet 130. However, the arrangement of the coil 140 is not limited to the aforementioned arrangement, and the coil may be wound around only the S pole piece 120, or may be wound around both of the N pole piece 110 and the S pole piece 120. Alternatively, the coil may be wound around any one of the portions upper and lower than the permanent magnet 130.

The base 150 is a magnetic substance. The base can move between a first position (the position in FIG. 2A) where the base is not in contact with both of the base attachment face 112 of the N pole piece 110 and the base attachment face 122 of the S pole piece 120, and a second position (the position in FIG. 2B) where the base is in contact with both of the base attachment face 112 of the N pole piece 110 and the base attachment face 122 of the S pole piece 120.

Referring to FIGS. 2A and 2B, the base 150 is guided to slide by bolts 151 fixed to the N pole piece 110 and the S pole piece 120 through the base 150 and receives a force applied upward by the springs 160 that are elastic members to be described below. Since counterbores 153 are formed at the base 150, the distance by which the base is separated from the N pole piece 110 and the S pole piece 120 can be limited by heads 152 of the bolts 151, even if the base 150 is pushed upward by the springs 160.

The springs 160 are a type of elastic members that apply an elastic force to the base 150 in a direction in which the base is away from the N pole piece 110 and the S pole piece 120. Elastic bodies such as rubber or polyurethane may be used as the elastic member in addition to the springs 160 of the exemplary embodiment.

It is preferable that the springs 160 and the bolts 151 be non-magnetic substances without influencing a magnetic flow between the N pole piece 110 and the base 150 and between the S pole piece 120 and the base.

The control device 170 controls the target 1 to be attached or released by controlling a current applied to the coil 140. For reference, the control device is provided in the following exemplary embodiments but the control device not shown in the figures.

The principle of holding and releasing the target 1 formed of a magnetic substance by the magnetic substance holding device 100 having the configuration described above is described hereafter.

Referring to FIG. 2A, by magnetizing the N pole piece 110 and the S pole piece 120 by using the permanent magnet 130 while a current is not applied to the coil 140, attraction is generated between the N pole piece 110 and the target 1 and between the S pole piece 120 and the target, so that the target 1 is finally attached to the holding faces 111 and 121.

After the target is attached to the holding faces, since the base 150 is spaced from the N pole piece 110 and the S pole piece 120 by the springs 160, the magnetic flow from the permanent magnet 130 does not flow to the base 150 and the magnetic flow shown by the dotted line in FIG. 2A is generated, so that the target 1 is firmly fixed.

Once the magnetic flow shown by the dotted line is generated through the target 1, since the entire magnetic flows move as shown by the dotted line, no magnetic force is generated through the base 150. Therefore, the magnetic force of the permanent magnet 130 can be used to hold the target 1 without a loss of the magnetic force, so that an efficient holding force can be achieved.

Further, in order to increase the strength of attachment, a current is applied to the coil 140 such that an N pole is formed downward in FIG. 2A. When a current is applied to the coil 140, the N pole piece 110 is magnetized by electromagnetic induction as in an electromagnet, so that a stronger magnetic force can be produced.

Releasing the target 1 from the magnetic substance holding device 100 is described with reference to FIG. 2B.

As shown in FIG. 2B, when a current is applied to the coil 140 such that an S pole is formed toward the permanent magnet 130, the magnetic force that attracts the base 150 increases and the base 150 is attached to the base attachment faces 112 and 122 against the elastic force of the springs 160. That is, the base 150 moves to the second position.

As the base 150 is attached to the base attachment faces 112 and 122, magnetic flow is formed along the path of permanent magnet 130-N pole piece 110-base 150-S pole piece 120-permanent magnet 130 and the magnetic flow of the permanent magnet 130 is induced to not the target 1 but the base 150 by the coil 140, so that magnetic flow is not formed into the target 1.

Accordingly, the target 1 can be released from the holding face 111 of the N pole piece 110 and the holding face 121 of the S pole piece 120. Thereafter, even if the current applied to the coil 140 is stopped, since the base 150 does not return to the first position and the magnetic flow through the base 150 is maintained, so that the target 1 cannot be attached to the holding faces 111 and 121.

In order to hold the target 1 again, it is required to return the base 150 to the first position shown in FIG. 2A by the elastic force of the springs 160 by allowing a current to flow in the coil 140 in a direction opposite to that of FIG. 2B. That is, it is possible to return the base 150 to the first position by decreasing the magnitude of the magnetic flow shown by the dotted line in FIG. 2B by the coil 140.

A noticeable point in the this configuration is that once the closed-loop magnetic flow is formed, as depicted by the dotted lines in FIGS. 2A and 2B, even if another closed-loop path is formed by a magnetic substance, the magnetic flow keeps the direction in which the closed-loop magnetic flow is formed and magnetic flow is not formed along the another closed-loop path. That is, as shown in FIG. 2B, when the base 150 is attached to the N pole piece 110 and the S pole piece 120 and the magnetic flow shown by the dotted line is formed, little or no magnetic flow is generated through the target 1, even if the target 1 comes in contact with the holding faces 111 and 121. Accordingly, it is possible to control magnetic flow to the holding faces 111 and 121 by using the base 150 that comes in contact with or does not comes in contact with the N pole piece 110 and the S pole piece 120. Therefore, it is exemplified in the exemplary embodiment that the base 150 can move between the first position and the second position.

On the other hand, there is a need to appropriately adjust the modulus of elasticity of the springs 160. For example, when the modulus of elasticity of the springs 160 is too small, it is required to supply a large amount of current to the coil 140 in order to return the base 150 to the first position, after the base 150 is attached to the N pole piece 110 and the S pole piece 120 as shown in FIG. 2B. In contrast, when the modulus of elasticity of the springs 160 is too large, since it is required to a large amount of current to the coil 140 in order to attach the base 150 to the base attachment faces 112 and 122 when releasing the target 1, this is not preferable. The modulus of elasticity of the springs 160 may be determined by experiences or experiments in consideration of the magnitude of the magnetic force that can be induced to the coil 140.

Further, as well as the modulus of elasticity of the springs 160, the distance by which the base 150 disposed at the first position is separated from the base attachment faces 112 and 122 should also be appropriately determined. This is because when the distance is too long, the base 150 may not be attached to the base attachment faces 112 and 122, even if a current is applied to the coil 140, whereas when the distance is too short, the base 150 may be attached to the base attachment faces 112 and 122, even if a current is not applied to the coil 140. Accordingly, in consideration of this point, only when a predetermined amount of current is applied to the coil 140, the separation distance between the base 150 disposed at the first position and the base attachment faces 112 and 122 should be adjusted such that the base 150 can be attached to the base attachment faces 112 and 122. The adjustment may be performed by experiences or experiments in consideration of the magnitude of the magnetic force that can be induced to the coil 140 and the modulus of elasticity of the springs 160.

Further, the separation distance may be easily adjusted by the bolts 151 fastened to the N pole piece 110 and the S pole piece 120.

Figure 3A:
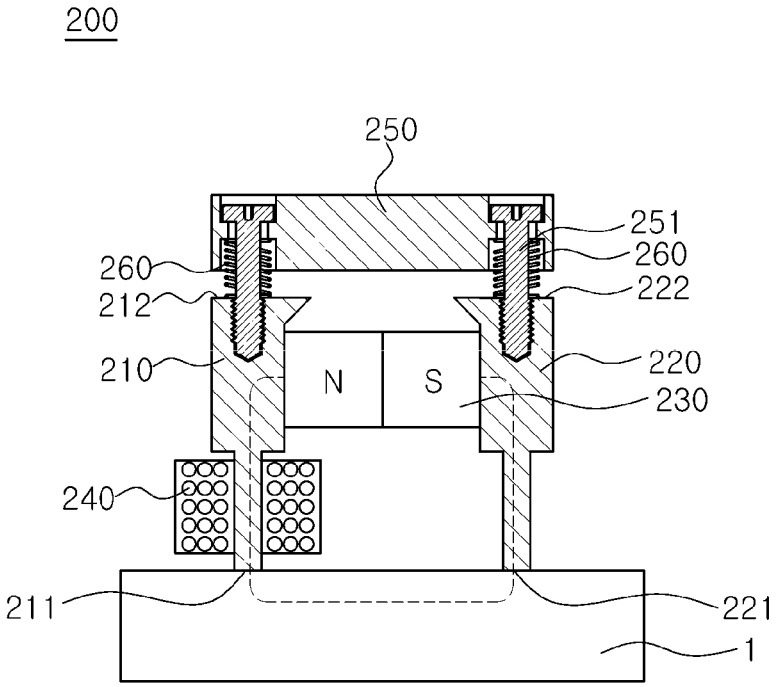
FIG. 3A is a schematic cross-sectional view when a magnetic substance holding device according to another exemplary embodiment of the present invention holds the target.
Figure 3B:
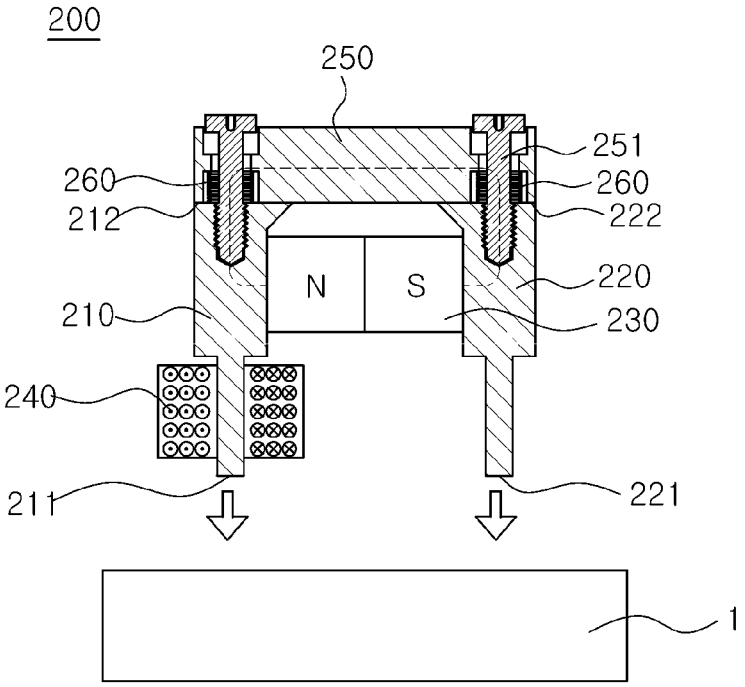
FIG. 3B is a schematic cross-sectional view when the magnetic substance holding device shown in FIG. 3A releases the target.

FIG. 3A is a schematic cross-sectional view when a magnetic substance holding device according to another exemplary embodiment of the present invention holds the target, and FIG. 3B is a schematic cross-sectional view when the magnetic substance holding device shown in FIG. 3A releases the target.

Referring to FIGS. 3A and 3B, a magnetic substance holding device 200 according to another exemplary embodiment of the present invention includes an N pole piece 210, an S pole piece 220, a permanent magnet 230, a coil 240, a base 250, springs 260, and a control device (not shown).

The magnetic substance holding device 200 of the exemplary embodiment follows the same principle as that of the magnetic substance holding device 100 shown in FIGS. 1 to 2B and thus only the differences there between are described in detail.

In the magnetic substance holding device 200 of the exemplary embodiment, unlike the magnetic substance holding device 100 shown in FIGS. 1 to 2B, the permanent magnet 230 is positioned close to the base 250 and the coil 240 is positioned close to a holding face 211. That is, the coil 240 is positioned further from the base 250 than the permanent magnet 230.

Further, in the magnetic substance holding device 200 of the exemplary embodiment, the sum of an area of a base attachment face 212 of the N pole piece 210 and an area of a base attachment face 222 of the S pole piece 220 is larger than the sum of an area of the holding face 211 of the N pole piece 210 and an area of a holding face 221 of the S pole piece 220.

Accordingly, the magnetic force of the permanent magnet 230 can be efficiently induced to the base 250, when the target 1 is released, so that the remaining magnetism that may be generated on the holding faces 211 and 221 can be minimized.

Figure 4:
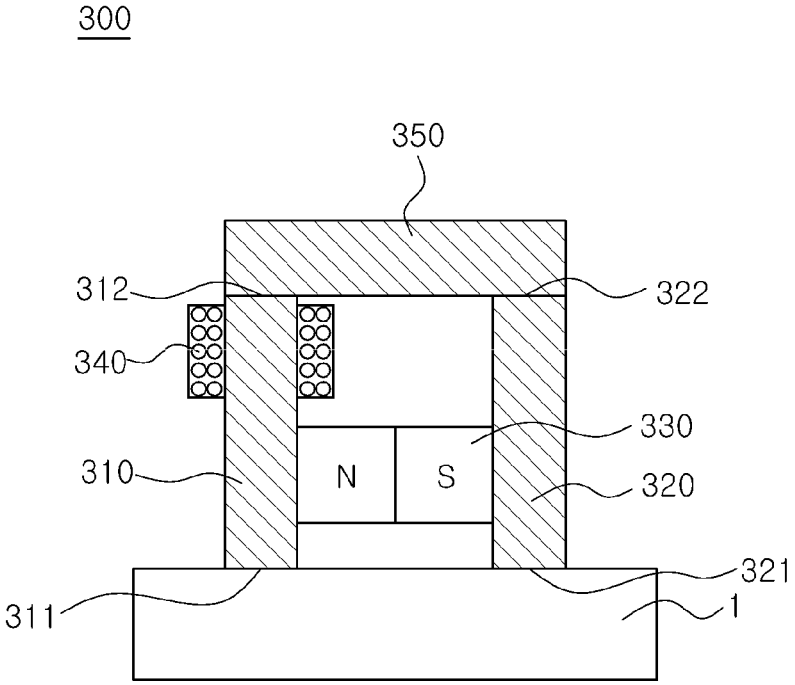
FIG. 4 is a schematic cross-sectional view of a magnetic substance holding device according to still another exemplary embodiment of the present invention.

FIG. 4 is a schematic cross-sectional view of a magnetic substance holding device according to still another exemplary embodiment of the present invention.

Referring to FIG. 4, a magnetic substance holding device 300 according to still another exemplary embodiment of the present invention includes an N pole piece 310, an S pole piece 320, a permanent magnet 330, a coil 340, a base 350, and a control device (not shown).

The magnetic substance holding device 300 of the exemplary embodiment is different from the magnetic substance holding devices 100 and 200 in that the springs are not used as the elastic members and the base 350 is fixed so as to come in contact with a base attachment face 312 of the N pole piece 310 and a base attachment face 322 of the S pole piece 320, and the other configurations are all the same.

In the magnetic substance holding device 300 of the exemplary embodiment, when holding the target, the direction of the magnetic flow through the base 350 is changed by applying a current to the coil 340 through the control device (not shown) such that the magnetic flow from the N pole of the permanent magnet 330 moves to a holding face 311 of the N pole piece 310. Accordingly, the target 1 can be attached to holding faces 311 and 321.

In contrast, when releasing the target, the direction of the magnetic flow through the target 1 is changed by applying a current to the coil 340 through the control device (not shown) such that the magnetic flow from the N pole of the permanent magnet 330 moves to the base attachment faces 312 of the N pole piece 310. Accordingly, the target 1 can be released from the holding faces 311 and 321.

Figure 5:
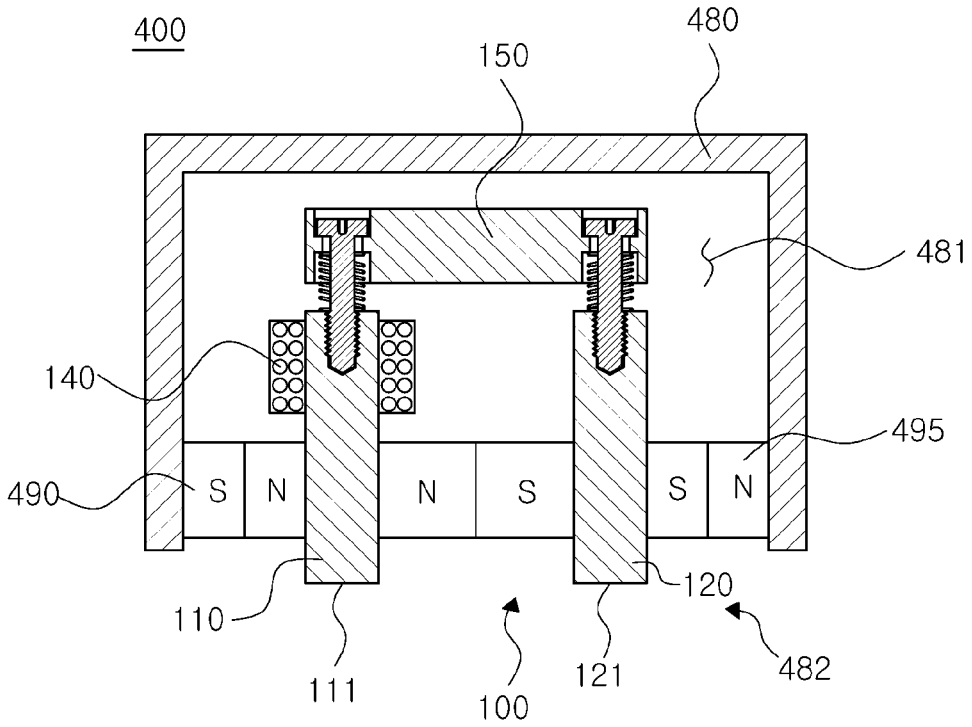
FIG. 5 is a schematic cross-sectional view of a magnetic substance holding device according to still another exemplary embodiment of the present invention.

FIG. 5 is a schematic cross-sectional view of a magnetic substance holding device according to still another exemplary embodiment of the present invention.

Referring to FIG. 5, a magnetic substance holding device 400 according to the exemplary embodiment further includes a yoke 480, a first reinforced permanent magnet 490, and a second reinforced permanent magnet 495, in addition to the configuration of the magnetic substance holding device 100 shown in FIGS. 1 to 2B.

The yoke 480 has an empty space therein and an opening 482 formed toward the outside. The yoke is a magnetic substance.

The base 150 is disposed in the empty space 481 of the yoke 480 and the holding faces 111 and 121 of the N pole piece 110 and the S pole piece 120 are exposed to the outside through the opening 482.

The first reinforced permanent magnet 490 may be disposed between the yoke 480 and the N pole piece 110 such that the N pole comes in contact with the N pole piece 110 and the S-pole comes in contact with the yoke 480. Further, the second reinforced permanent magnet 495 may be disposed between the yoke 480 and the S pole piece 120 such that the S-pole comes in contact with the S pole piece 120 and the N pole comes in contact with the yoke 480. In this configuration, both or only any one of the first reinforced permanent magnet 490 and the second reinforced permanent magnet 495 may be provided.

In the exemplary embodiment, it is exemplified that the yoke 480, the first reinforced permanent magnet 490, and the second reinforced permanent magnet 495 are added to the magnetic substance holding device 100 shown in FIGS. 1 to 2B, but the present invention is not limited thereto and the yoke 480, the first reinforced permanent magnet 490, and the second reinforced permanent magnet 495 may be added to the magnetic substance holding device 200 shown in FIGS. 3A and 3B and the magnetic substance holding device 300 shown in FIG. 4. Those configurations are not described in detail.

According to the magnetic substance holding device 400 of the exemplary embodiment, since the permanent magnets are further attached to the N pole piece 110 and the S pole piece 120, a large attaching force can be achieved even at a limited occupying area, the yoke 480 functions as a case, and excellent esthetic appearance can be expected.

Figure 6A:
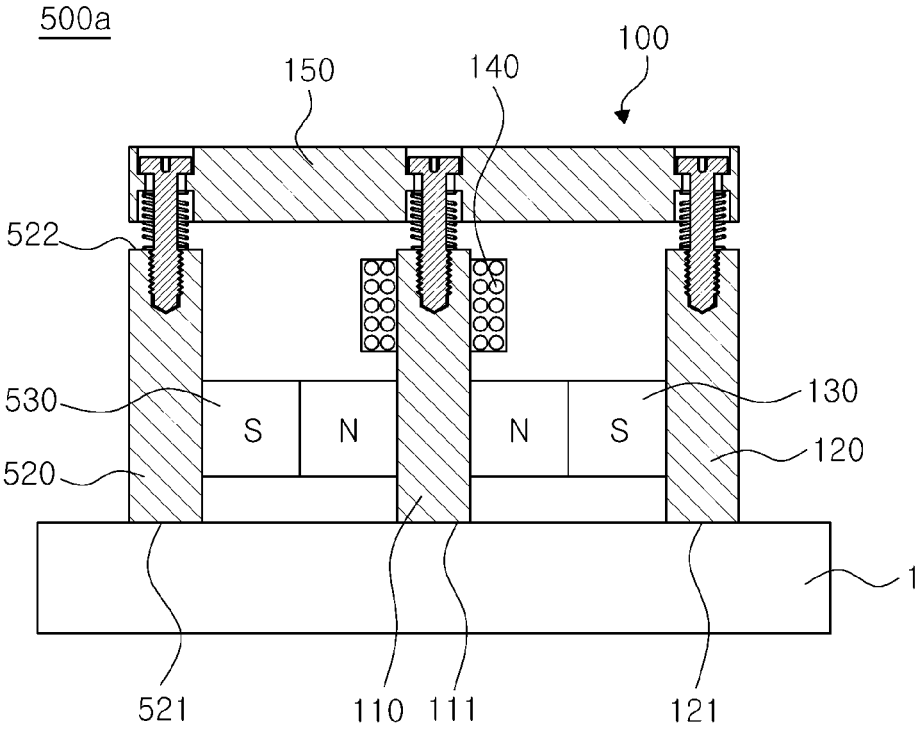
FIGS. 6A and 6B are schematic cross-sectional views of magnetic substance holding devices according to still other exemplary embodiments of the present invention.
Figure 6B:
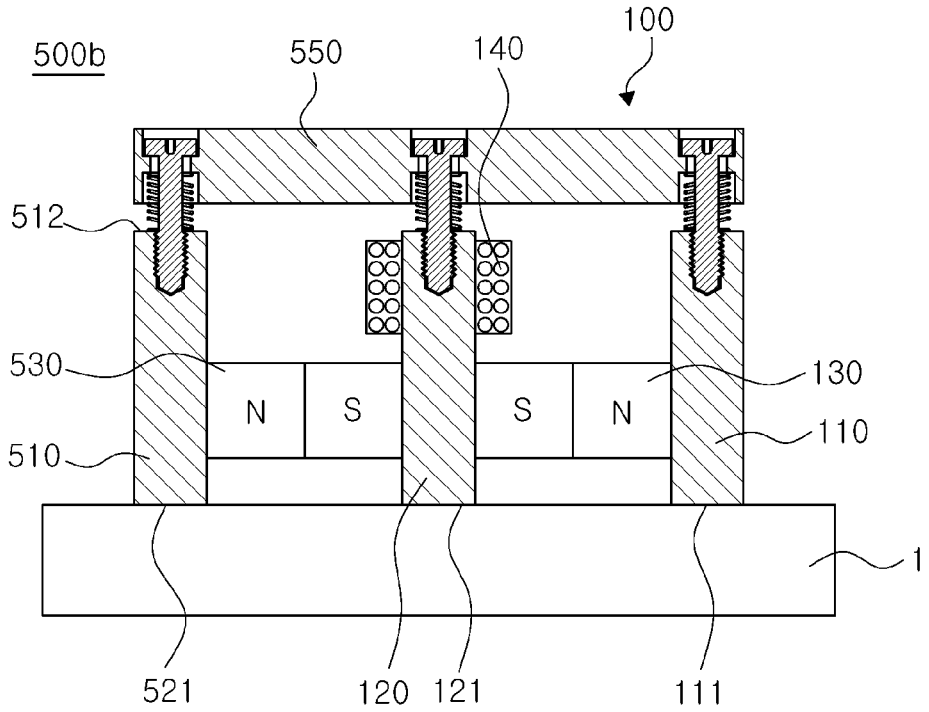

FIGS. 6A and 6B are schematic cross-sectional views of magnetic substance holding devices 500*a* and 500*b* according to still other exemplary embodiments of the present invention.

Referring to FIG. 6A, the magnetic substance holding device 500*a* according to the exemplary embodiment further includes a second S pole piece 520 and a second permanent magnet 530, in addition to the configuration of the magnetic substance holding device 100 shown in FIGS. 1 to 2B.

The second S pole piece 520 has a holding face 521 to which the target 1 is attached and a base attachment face 522 at the different side from the holding face 521. The second S pole piece is a magnetic substance.

The second permanent magnet 530 is disposed such that the N pole comes in contact with the N pole piece 110 and the S-pole comes in contact with the second S pole piece 520.

The coil 140 is preferably wound around the N pole piece 110 in order to effectively control magnetic flow and in order not to expose the coil 140, but the present invention is not limited thereto, and the coil may be wound around other pole pieces 120 and 520.

The magnetic substance holding device 500*b* shown in FIG. 6B is different from the magnetic substance holding device 500*a* shown in FIG. 6A in that an S pole piece 120 is disposed at the middle portion, an N pole piece 110 and a second N pole piece 510 are disposed at both sides thereof, and a second permanent magnet 530 is disposed such that the S-pole comes in contact with the S pole piece 120 and the N pole comes in contact with the second N pole piece 510. The basic principle of the magnetic substance holding device 500*b* shown in FIG. 6B is the same as that of the magnetic substance holding device 500*a* shown in FIG. 6A, so that the detailed description thereof is not provided.

The bases 150 and 550 of the magnetic substance holding devices 500*a* and 500*b* shown in FIGS. 6A and 6B extend to be able to come in contact with all of three pole pieces.

Figure 7:
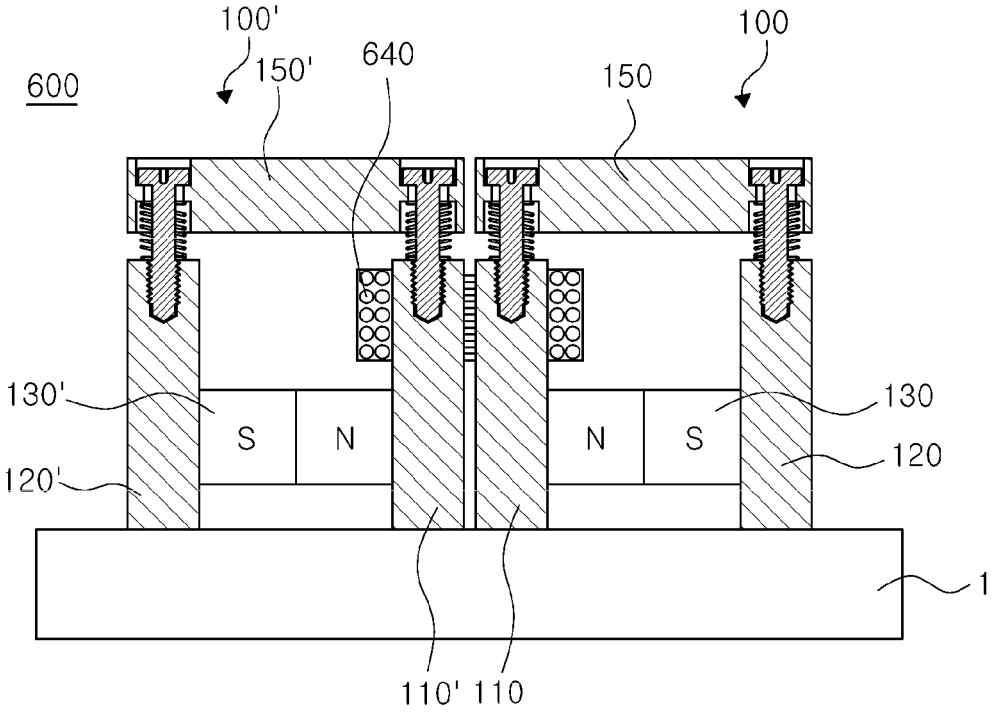
FIG. 7 is a schematic cross-sectional view of a magnetic substance holding device according to still another exemplary embodiment of the present invention.

FIG. 7 is a schematic cross-sectional view of a magnetic substance holding device 600 according to still another exemplary embodiment of the present invention.

Referring to FIG. 7, the magnetic substance holding device 600 according to the exemplary embodiment is implemented by arranging two or more of the magnetic substance holding device 100 shown in FIGS. 1 to 2B.

FIG. 7 shows an example with a case where two magnetic substance holding devices 100 are arranged, and N pole pieces 110 and 110' are disposed so as to face each other, but may be spaced from each other. It is preferable that a coil 640 surround all of the N pole pieces 110 and 110', as shown in FIG. 7. However, the present invention is not limited thereto, and the N pole pieces 110 and 110' may be individually equipped with a coil.

Unlike the configuration shown in FIG. 7, S pole pieces 120 and 120' may be disposed so as to face each other, but may be spaced from each other, and the coil 640 may surround all of the S pole pieces 120 and 120'.

Other configurations are the same as the configurations of the magnetic substance holding device 100 shown in FIGS. 1 to 2B, and thus the detailed descriptions thereof are not provided.

Figure 8:
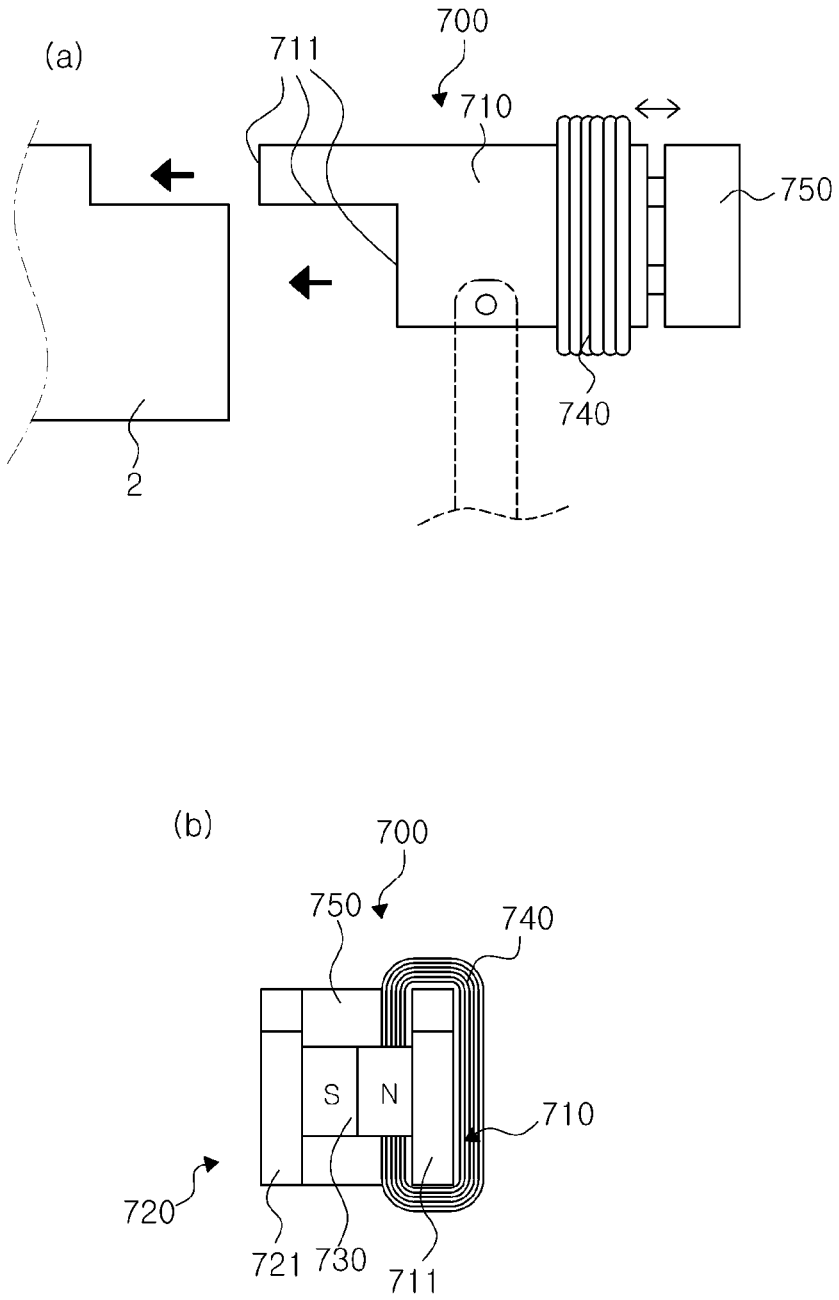
FIG. 8 shows a schematic front view and a left side view of a magnetic substance holding device according to still another exemplary embodiment of the present invention.

FIG. 8 shows a schematic front view and a left side view of a magnetic substance holding device 700 according to still another exemplary embodiment of the present invention.

Referring to FIG. 8, a target 2 and one or more of a holding face 711 of an N pole piece 710 and a holding face 721 of an S pole piece 720 may be fitted to each other. In FIG. 8, the target 2 is formed such that three flat faces form two edges and the N pole piece 710 and the S pole piece 720 respectively have the holding faces 711 and 721 so as to be in contact with all of the three flat faces.

Accordingly, when holding the target, the holding faces 711 and 721 hold the target 2 at specific positions. That is, according to that the exemplary embodiment shown in FIG. 8, the target 2 is held such that the edges formed by the three flat faces are positioned so as to face edges of the holding faces 711 and 712.

On the other hand, the magnetic substance holding device may be configured such that any one of the N pole piece 710 and the S pole piece 720 may be fitted to the target 2 and the other one is not fitted. Those various items of application may be achieved by changing the holding faces and the target in various ways.

When the magnetic substance holding device 700 of the exemplary embodiment is used, the target is held at an accurate position. Further, the sides of the target 2 are held by a magnetic force and the portion where the force is applied (the side perpendicular to the gravitational direction in (a) of FIG. 8 is held, so that a large holding force can be effectively provided by the shape of the holding faces in addition to the magnetic force.

Since the magnetic substance holding device 700 of the exemplary embodiment has the structure that is fixed to a certain portion and held in the direction of force, the magnetic substance holding device can be used to pull or fix a certain target. For example, the magnetic substance holding device may be used for die clamps, locking devices, connection devices of passenger cars of a train, and roll lifting. In particular, the magnetic substance holding device may be fixed to a certain position by being connected through the connection link shown by the dotted line in (a) of FIG. 8.

The exemplary embodiments of the present invention have been described in more detail with reference to the accompanying drawings, but the present invention is not limited to the exemplary embodiments. It will be apparent to those skilled in the art that various modifications can be made without departing from the technical sprit of the invention. Accordingly, the exemplary embodiments disclosed in the present invention are used not to limit but to describe the technical spirit of the present invention, and the technical spirit of the present invention is not limited to the exemplary embodiments. Therefore, the exemplary embodiments described above are considered in all respects to be illustrative and not restrictive. The protection scope of the present invention must be interpreted by the appended claims and it should be interpreted that all technical spirits within a scope equivalent thereto are included in the appended claims of the present invention.

For example, the structure of fixing the base 350 in the magnetic substance holding device 300 shown in FIG. 4 may be used for all of other exemplary embodiments.

What is claimed is:

1. A magnetic substance holding device that controls permanent magnet energy, the device comprising:

an N pole piece formed of a magnetic substance, wherein the N pole piece has a holding face to which a target formed of a magnetic substance is attached and a base attachment face at a side different from the holding face;

an S pole piece formed of a magnetic substance, wherein the S pole piece has a holding face to which the target is attached and a base attachment face at a side different from the holding face;

a permanent magnet that is disposed such that the N pole thereof comes in contact with the N pole piece and the S-pole thereof comes in contact with the S pole piece;

a coil that is wound around at least one of the N pole piece and the S pole piece;

a base that is movable between a first position at which the base does not come in contact with both of the base attachment face of the N pole piece and the base attachment face of the S pole piece and a second position at which the base comes in contact with both of the base attachment face of the N pole piece and the base attachment face of the S pole piece; and a control device that controls a current applied to the coil, wherein the target is held or released by applying a current to the coil through the control device such that at least one of the N pole piece and the S pole piece is magnetized, when the base is disposed at the first position, the target is attached to the holding faces of the N pole piece and the S pole piece, and the target is released from the holding faces of the N pole piece and the S pole piece by applying a current to the coil to generate a magnetic flow through the base attachment face of the N pole piece and the base attachment face of the S pole piece and by moving the base to the second position by a magnetic force.

2. The magnetic substance holding device that controls permanent magnet energy according to claim 1, further comprising:

an elastic member that provides an elastic force in a direction in which the base is away from the N pole piece and the S pole piece.

3. The magnetic substance holding device that controls permanent magnet energy according to claim 2, wherein the N pole piece is a first N pole piece, the S pole piece is a first S pole piece, the permanent magnet is a first permanent magnet, the base is a first base, and the elastic member is a first elastic member, the device further includes:

a second N pole piece formed of a magnetic substance, wherein the second N pole piece has a holding face to which a target formed of a magnetic substance is attached and a base attachment face at a side different from the holding face;

a second S pole piece formed of a magnetic substance, wherein the second S pole piece has a holding face to which a target formed of a magnetic substance is attached and a base attachment face at a side different from the holding face;

a second permanent magnet that is disposed such that the N pole thereof comes in contact with the second N pole piece and the S-pole thereof comes in contact with the second S pole piece;

a second base formed of a magnetic substance, wherein the second base is movable between a first position at which the second base does not come in contact with both of the base attachment face of the second N pole piece and the base attachment face of the second S pole piece and a second position at which the base comes in contact with both of the base attachment face of the second N pole piece and the second base attachment face of the second S pole piece; and a second elastic member that provides an elastic force pushing the second base in a direction in which the second base is away from the second N pole piece and the second S pole piece, wherein the first N pole piece and the second N pole piece face each other but are spaced from each other, and the coil is disposed to surround both of the first N pole piece and the second N pole piece.

4. The magnetic substance holding device that controls permanent magnet energy according to claim 2, wherein the N pole piece is a first N pole piece, the S pole piece is a first S pole piece, the permanent magnet is a first permanent magnet, the base is a first base, and the elastic member is a first elastic member, the device further includes:

a second N pole piece formed of a magnetic substance, wherein the second N pole piece has a holding face to which a target formed of a magnetic substance is attached and a base attachment face at a side different from the holding face;

a second S pole piece formed of a magnetic substance, wherein the second S pole piece has a holding face to which the target formed of a magnetic substance is attached and a base attachment face at a side different from the holding face;

a second permanent magnet that is disposed such that the N pole thereof comes in contact with the second N pole piece and the S-pole thereof comes in contact with the second S pole piece;

a second base formed of a magnetic substance, wherein the second base is movable between a first position at which the second base does not come in contact with both of the base attachment face of the second N pole piece and the base attachment face of the second S pole piece and a second position at which the second base comes in contact with both of the base attachment face of the second N pole piece and the base attachment face of the second S pole piece; and a second elastic member that provides an elastic force in a direction in which the second base is away from the second N pole piece and the second S pole piece, wherein the first S pole piece and the second S pole piece face each other but are spaced from each other, and the coil is disposed to surround both of the first S pole piece and the second S pole piece.

5. The magnetic substance holding device that controls permanent magnet energy according to claim 1, wherein the coil is wound around only the N pole piece and is positioned closer to the base than the permanent magnet.

6. The magnetic substance holding device that controls permanent magnet energy according to claim 1, wherein the coil is wound around only the N pole piece and is positioned further from the base than the permanent magnet, and the sum of an area of the base attachment face of the N pole piece and an area of the base attachment face of the S pole piece is larger than that the sum of an area of the holding face of the N pole piece and an area of the holding face of the S pole piece.

7. The magnetic substance holding device that controls permanent magnet energy according to claim 1, further comprising:

a yoke that has an empty space therein and an opening, wherein the base is disposed within the empty space and the holding faces of the N pole piece and the S pole piece are exposed to the outside through the opening, and a first reinforced permanent magnet is disposed between the yoke and the N pole piece such that the N pole thereof comes in contact with the N pole piece and the S-pole thereof comes in contact with the yoke, or a second reinforced permanent magnet is disposed between the yoke and the S pole piece such that the S-pole thereof comes in contact with the S pole piece and the N pole thereof comes in contact with the yoke.

8. The magnetic substance holding device that controls permanent magnet energy according to claim 1, wherein the S pole piece is a first S pole piece and the permanent magnet is a first permanent magnet, the device further includes:

a second S pole piece formed of a magnetic substance, wherein the second S pole piece has a holding face to which the target is attached and a base attachment face at a side different from the holding face; and a second permanent magnet that is disposed such that the N pole thereof comes in contact with the N pole piece and the S-pole thereof comes in contact with the second S pole piece, wherein the coil is wound around the N pole piece, and the base extends to face the base attachment face of the second S pole piece.

9. The magnetic substance holding device that controls permanent magnet energy according to claim 1, wherein the N pole piece is a first N pole piece and the permanent magnet is a first permanent magnet, the device further includes:

a second N pole piece formed of a magnetic substance, wherein the second N pole piece has a holding face to which a target formed of a magnetic substance is attached and a base attachment face at a side different from the holding face; and a second permanent magnet that is disposed such that the S-pole thereof comes in contact with the S pole piece and the N pole thereof comes in contact with the second N pole piece, wherein the coil is wound around the S pole piece, and the base extends to face the base attachment face of the second N pole piece.

10. The magnetic substance holding device that controls permanent magnet energy according to claim 1, wherein the target and one or more of the holding face of the N pole piece and the holding face of the S pole piece are fitted to each other, and the one or more of the holding face of the N pole piece and the holding face of the S pole piece is held at a predetermined position of the target when holding.

* * * * *